US005310564A

United States Patent [19]

Kimm

[11] Patent Number: 5,310,564

[45] Date of Patent: May 10, 1994

[54] MULTIPLE FLAVOR CONTAINER

[76] Inventor: Hans M. Kimm, P.O. Box 188, Elmendorf AFB, Ak. 99506

[21] Appl. No.: 17,605

[22] Filed: Feb. 16, 1993

[51] Int. Cl.[5] ..... B65D 1/04; B65D 77/08; B65D 85/72

[52] U.S. Cl. ..... 426/115; 206/217; 206/219; 215/6; 426/120; 426/124

[58] Field of Search ..... 426/115, 120, 124; 206/217, 219; 215/6, DIG. 8

[56] References Cited

U.S. PATENT DOCUMENTS

| | | | |
|---|---|---|---|
| 1,254,115 | 1/1918 | Brand | 426/115 |
| 3,326,363 | 6/1967 | Bennett et al. . | |
| 3,743,520 | 7/1973 | Croner . | |
| 4,518,082 | 5/1985 | Ye | 206/217 |
| 4,537,308 | 8/1985 | Hollander, Jr. | 206/219 |
| 4,785,931 | 11/1988 | Weir et al. | 215/6 |
| 4,967,939 | 11/1990 | Taylor | 366/136 |

*Primary Examiner*—Michael W. Ball
*Assistant Examiner*—Richard Crispino
*Attorney, Agent, or Firm*—Leon Gilden

[57] ABSTRACT

A container having flexible side walls includes a plurality of tubular members mounted within the container in contiguous communication with the side wall, wherein flexure of the side walls in adjacency to selective ones of the tubular members effects rupture of the tubular members to disperse flavoring within the container as desired. Further, the tubular members contain at least one of the tubular members formed with a pump mechanism to circulate fluid from the container through the flavoring of the tubular member.

2 Claims, 4 Drawing Sheets

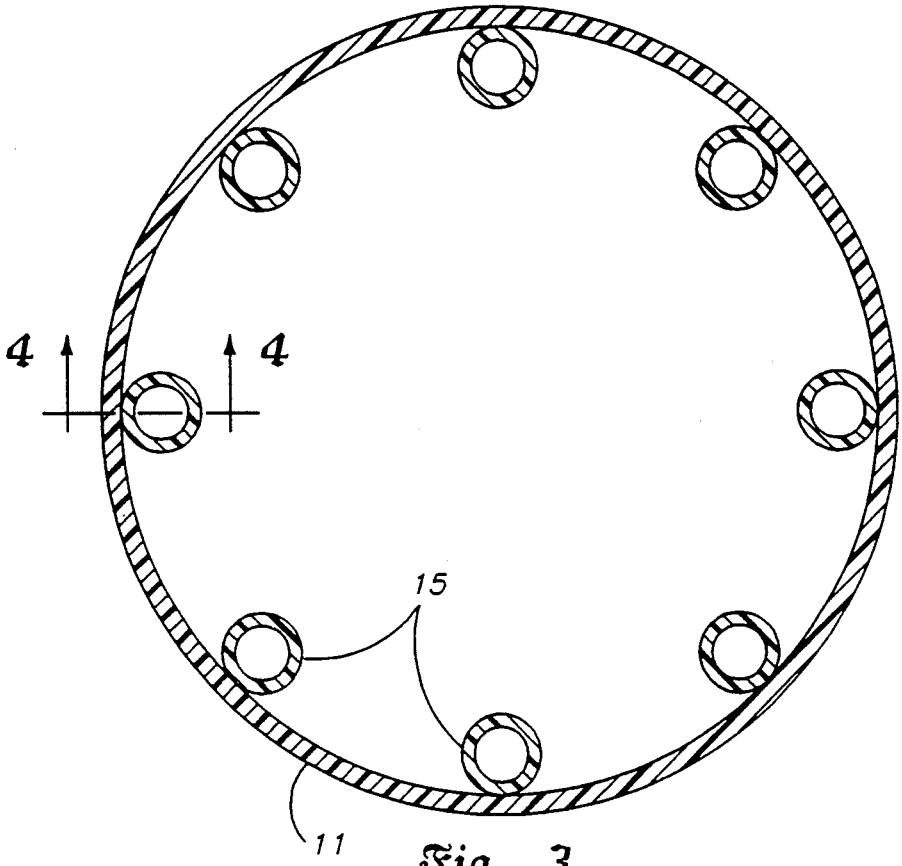
Fig. 3
Fig. 4
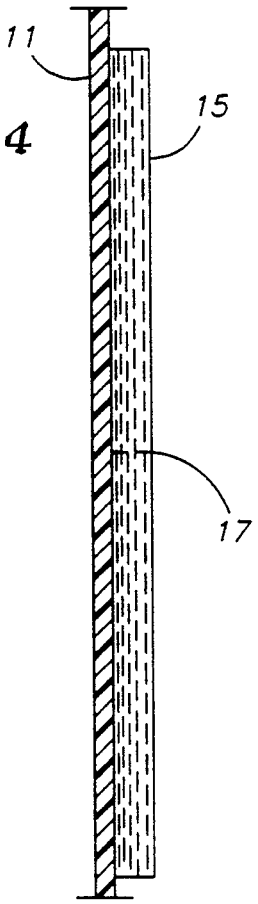
Fig. 5
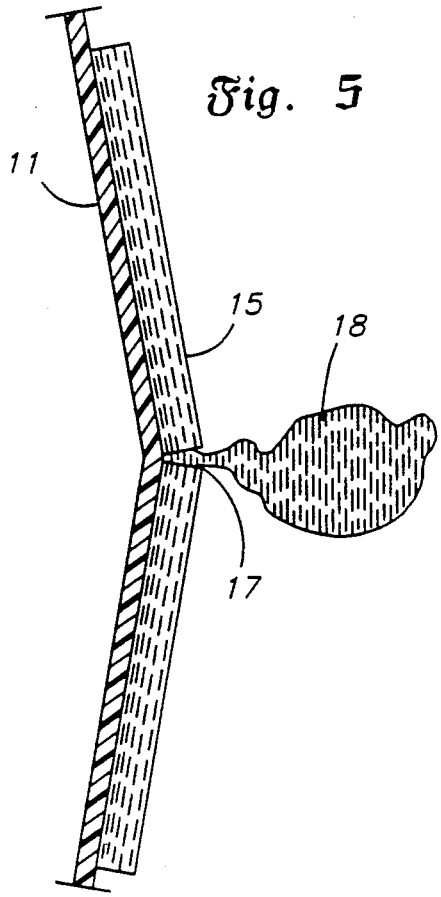

MULTIPLE FLAVOR CONTAINER

BACKGROUND OF THE INVENTION

1. Field of the Invention

The field of invention relates to container structure, and more particularly pertains to a new and improved multiple flavor container wherein the same is arranged to the flavoring of liquid within an associated container structure.

2. Description of the Prior Art

Flavoring of a container relative to an additive structure is indicated in U.S. Pat. No. 4,996,066 as an example, wherein a cassette member includes a plurality of separation ribs permitting flow of fluid through the cassette into an underlying cup to permit flavoring of fluid directed into the cup.

The instant invention attempts to overcome deficiencies of the prior art by providing for a flavor container providing internal mounting of flavoring tubes, wherein each of the tubes includes a flavoring additive arranged for mixture with fluid within the container in a selective manner and in this respect, the present invention substantially fulfills this need.

SUMMARY OF THE INVENTION

In view of the foregoing disadvantages inherent in the known types of flavor container structure now present in the prior art, the present invention provides a multiple flavor container wherein the same is arranged to permit selective imparting of a flavoring within a container fluid. As such, the general purpose of the present invention, which will be described subsequently in greater detail, is to provide a new and improved multiple flavoring container which has all the advantages of the prior art flavor container apparatus and none of the disadvantages.

To attain this, the present invention provides a container having flexible side walls, including a plurality of tubular members mounted within the container in contiguous communication with the side wall, wherein flexure of the side walls in adjacency to selective ones of the tubular members effects rupture of the tubular members to disperse flavoring within the container as desired. Further, the tubular members contain at least one of the tubular members formed with a pump mechanism to circulate fluid from the container through the flavoring of the tubular member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multiple flavor container which has all the advantages of the prior art flavor container apparatus and none of the disadvantages.

It is another object of the present invention to provide a new and improved multiple flavor container which may be easily and efficiently manufactured and marketed.

It is a further object of the present invention to provide a new and improved multiple flavor container which is of a durable and reliable construction.

An even further object of the present invention is to provide a new and improved multiple flavor container which is susceptible of a low cost of manufacture with regard to both materials and labor, and which accordingly is then susceptible of low prices of sale to the consuming public, thereby making such multiple flavor containers economically available to the buying public.

Still yet another object of the present invention is to provide a new and improved multiple flavor container which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 2 in the direction indicated by the arrows.

FIG. 4 is an orthographic view, taken along the lines 4—4 of FIG. 3 in the direction indicated by the arrows.

FIG. 5 is an orthographic view of a tubular member in a ruptured configuration relative to a side wall of the container structure.

DESCRIPTION OF THE PREFERRED EMBODIMENT

Figure 1:
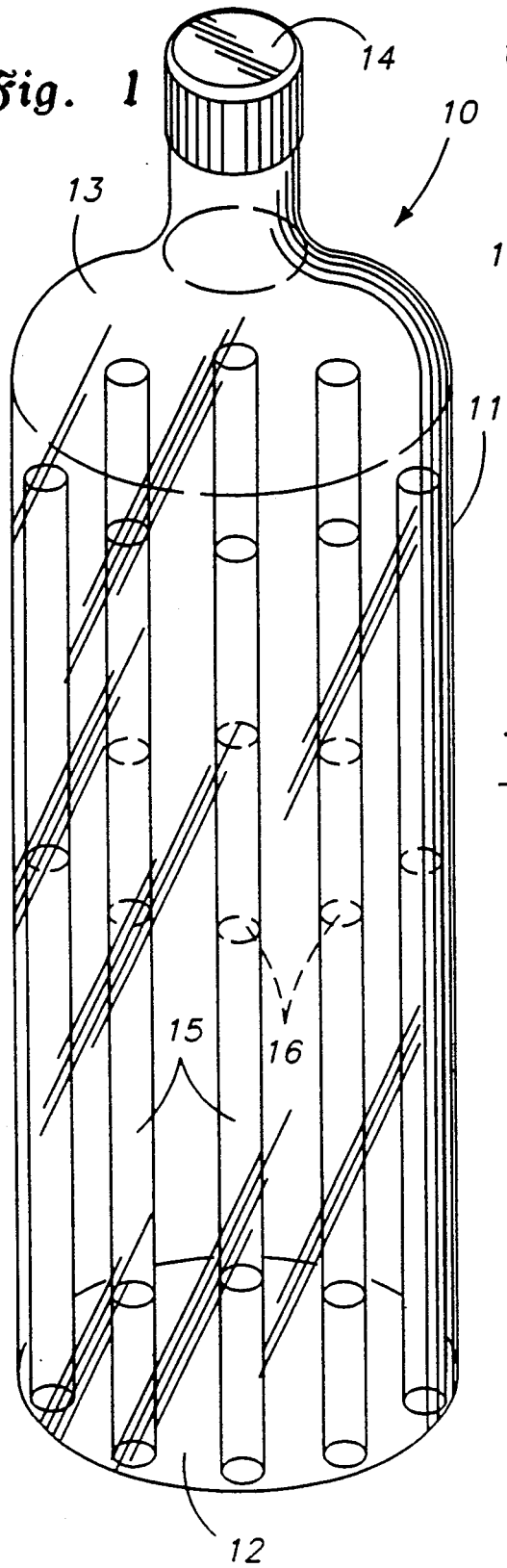
FIG. 1 is an isometric illustration of the invention.
Figure 2:
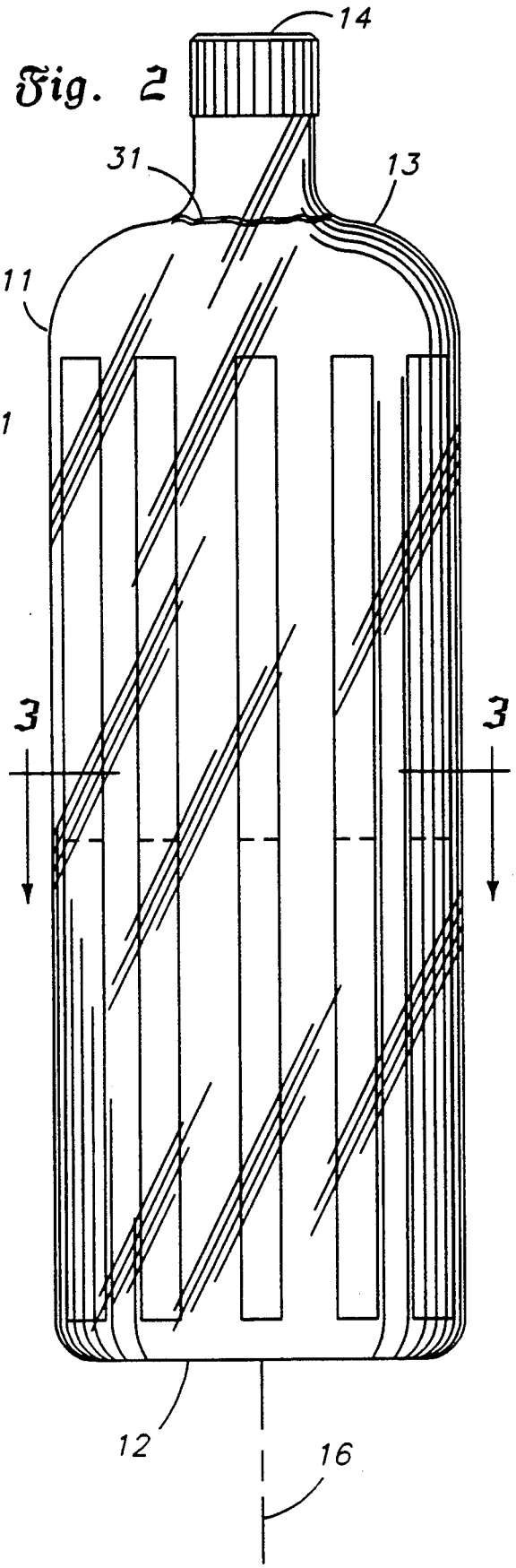
FIG. 2 is an orthographic side view of the invention taken in elevation.

With reference now to the drawings, and in particular to FIGS. 1 to 11 thereof, a new and improved multiple flavor container embodying the principles and concepts of the present invention and generally designated by the reference numeral 10 will be described.

More specifically, the multiple flavor container 10 of the instant invention essentially comprises a container flexible side wall 11, having a floor 12 and a neck 13, with a cap 14 removably mounted relative to the neck 13, with the container symmetrically oriented about a container axis 16. A plurality of parallel tubular members 15 are mounted in the container in contiguous securement to the side wall 11, with the tubular members 15 parallel to and concentrically oriented about the axis 16. Each of the tubular members includes a frangible portion 17 permitting rupture of the respective tubular members 15 upon flexure of the side wall 11 towards the axis 16, in a manner as indicated in FIG. 5. In this manner, a flavoring 18 either in a liquid or powder form contained within the tubular members 15 is projected into the container for mixture with the container fluid 31.

Figure 6:
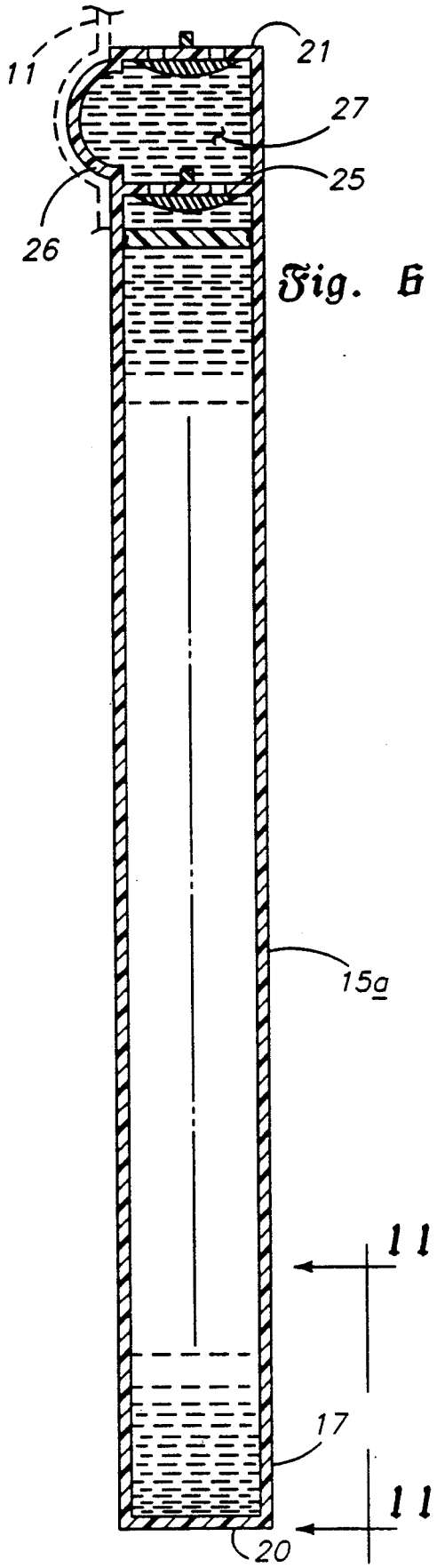
FIG. 6 is an orthographic side view of a modified tubular member of the invention.
Figure 7:
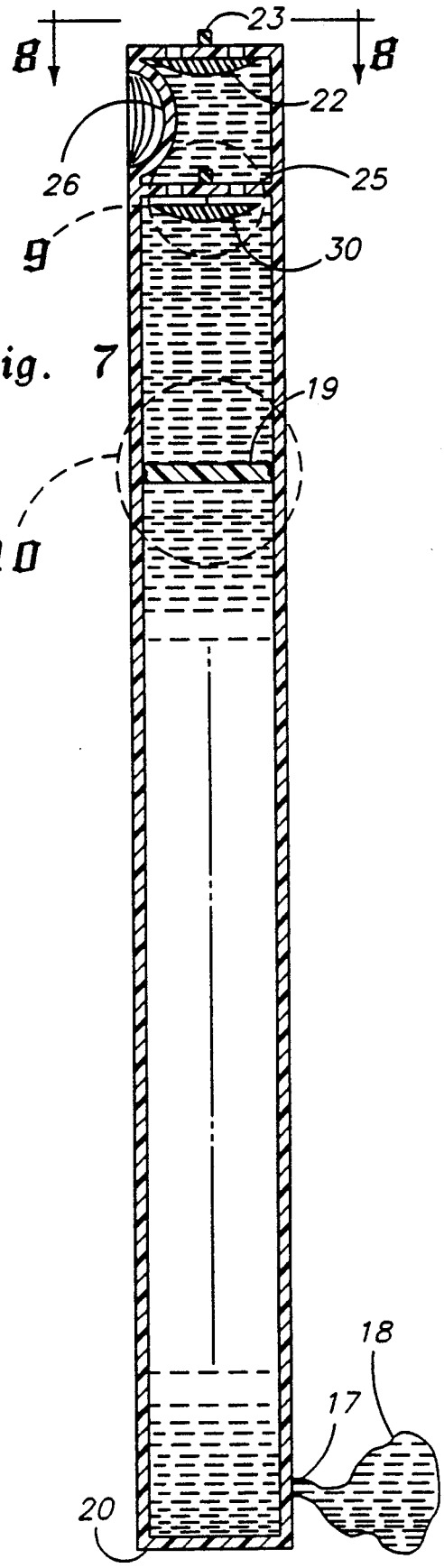
FIG. 7 is an orthographic side view of the tubular member arranged in operative association relative to a flavoring therewithin.
Figure 8:
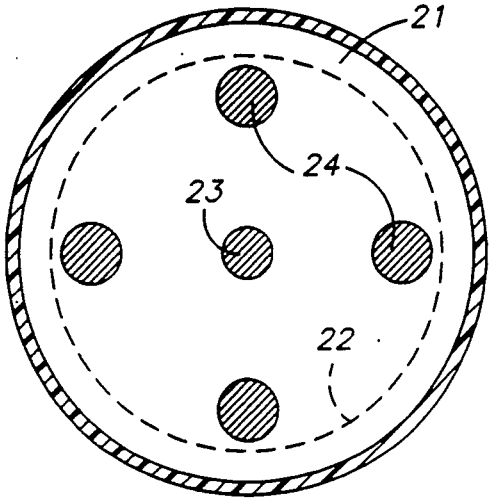
FIG. 8 is an orthographic view, taken along the lines 8—8 of FIG. 7 in the direction indicated by the arrows.
Figure 9:
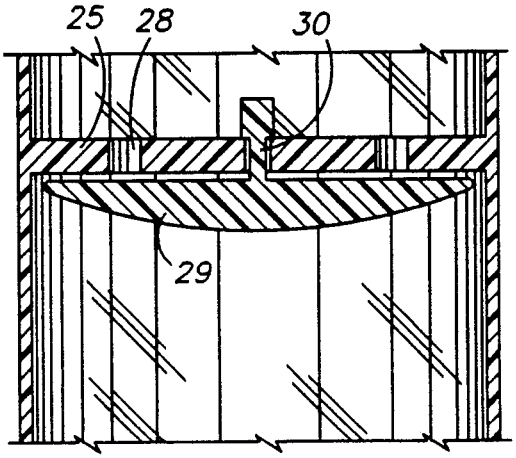
FIG. 9 is an orthographic view of section 9 as set forth in FIG. 7.
Figure 10:
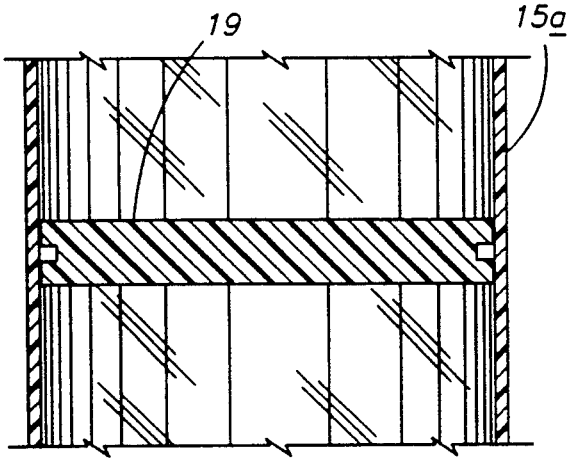
FIG. 10 is an orthographic view of section 10 as set forth in FIG. 7.
Figure 11:
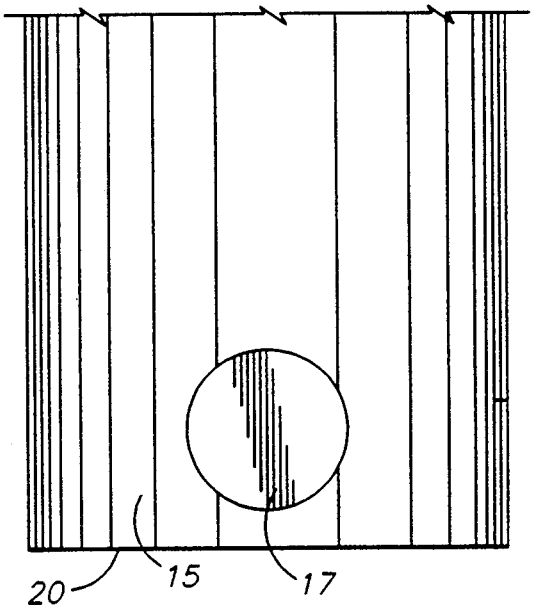
FIG. 11 is an orthographic view, taken along the lines 11—11 of FIG. 6 in the direction indicated by the arrows.

The FIGS. 6-11 indicate a modified tubular member 15*a* having a tubular member bottom wall 20 spaced from a tubular member top wall 21. The frangible portion 17 is oriented within the modified tubular member 15*a* adjacent the bottom wall 20. A resilient first sealing plate 22 is mounted within the modified tubular member in adjacency to the top wall 21, wherein the top wall 21 includes a plurality of top wall apertures 24 (see FIG. 8). A plunger 26 is mounted within a modified tubular member 15*a* for projection relative to the container side wall 11, wherein flexure of the side wall effects projection of the plunger into a plunger chamber 27 oriented between the top wall 21 and an intermediate wall 25. The plunger is formed of a shape-retentive material to effect its biasing exteriorly of the modified tubular member to permit repetitive plunging of the plunger 26 within the chambers 27. The first sealing plate 22 is supported about a first resilient sealing plate support shaft 23 directed medially of the first sealing plate 22, wherein projection of pressure into the chamber 27 effects sealing of the first sealing plate relative to the top wall, wherein projection of the plunger exteriorly of the chamber draws container fluid 31 from the container into the tubular member 15*a* through the top wall apertures 24. The intermediate wall 25 includes a second resilient sealing plate 29 mounted about a second resilient sealing plate support shaft 30, with the first sealing plate 22 oriented between the top wall 22 and the intermediate wall 25, with the second sealing plate 29 oriented between the intermediate wall 25 and a piston 19 that in turn is oriented between the intermediate wall 25 and the bottom wall 20. The intermediate wall 25 includes intermediate wall openings 28 as indicated in FIG. 9 to direct fluid from the chamber 27 between the intermediate wall 25 and the piston 19. In this manner, the container fluid 31 is circulated throughout the container as the piston 19 projects the flavoring 17 into the container and simultaneously directs fluid from the container through the modified tubular member, wherein repetitive manipulation of the plunger 26 effects such circulation not requiring shaking of contents within the container. At least one of the tubular members 15 may be formed of the modified construction, as indicated in FIGS. 6 and 7.

It should be noted that the frangible portion 17 may be formed of perforations to provide for a weakened area or alternatively, may be formed of a thinner web portion relative to the tubular member 15 or 15*a* to permit rupture of the portion 17 subject to pressurizing that portion either by flexure of the container side wall 11 or projection of the piston 19 towards the bottom wall 20.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multiple flavor container, comprising, a flexible container side wall, a container floor, a container neck, and a container cap mounted to the neck, with the container symmetrically oriented about a container axis, and a plurality of tubular members mounted in contiguous communication to the container side wall within the container between the container neck and the container floor, with the tubular members oriented concentrically about the axis, and each of the tubular members having a frangible portion, and a liquid flavoring contained within the tubular members, whereupon rupturing of the frangible portion effects projection of the liquid flavoring within the container, with the container having a container fluid therewithin for mixture with the liquid flavoring.

2. A container as set forth in claim 1 wherein at least one of the tubular members includes a tubular member bottom wall and a tubular member top wall, with the tubular member top wall including a plurality of top wall apertures, and a resilient first sealing plate mounted to the tubular member between the top wall and the bottom wall, and the resilient sealing plate includes a first resilient support shaft mounted to the sealing plate and to the top wall, and an intermediate wall spaced between the top wall and the bottom wall, wherein the intermediate wall includes a plurality of intermediate wall openings, and a second resilient plate having a second resilient plate support shaft mounted to the second resilient sealing plate and the intermediate wall, with the second resilient sealing plate positioned between the intermediate wall and the bottom wall, and a chamber oriented between the top wall and the intermediate wall, and a plunger formed of a shape retentive material mounted to the at least one tubular member between the top wall and the intermediate wall in fluid communication with the chamber and the plunger arranged for projection relative to the container side wall, wherein flexure of the side wall effects projection of the plunger into the chamber, and a piston member mounted slidably within the at least one tubular member between the intermediate wall and the bottom wall, with the frangible portion oriented in adjacency to the bottom wall between the piston and the bottom wall to effect rupture of the frangible portion upon projection of the piston towards the bottom wall upon pressurizing of the chamber by the plunger.

* * * * *